US009277344B2

(12) United States Patent
Lection et al.

(10) Patent No.: US 9,277,344 B2
(45) **Date of Patent: *Mar. 1, 2016**

(54) MULTI-DIMENSIONAL AUDIO TRANSFORMATIONS AND CROSSFADING

(75) Inventors: David B. Lection, Raleigh, NC (US); William G. Pagan, Durham, NC (US)

(73) Assignee: International Business Machines Corporation, Armonk, NY (US)

( * ) Notice: Subject to any disclaimer, the term of this patent is extended or adjusted under 35 U.S.C. 154(b) by 281 days.

This patent is subject to a terminal disclaimer.

(21) Appl. No.: 13/550,692

(22) Filed: Jul. 17, 2012

(65) Prior Publication Data

US 2013/0315400 A1 Nov. 28, 2013

Related U.S. Application Data

(63) Continuation of application No. 13/479,900, filed on May 24, 2012.

(51) Int. Cl.

| | |
|---|---|
| ***H04S 7/00*** | (2006.01) |
| ***H04S 1/00*** | (2006.01) |
| ***H04H 60/04*** | (2008.01) |

(52) U.S. Cl.

CPC ..... *H04S 7/40* (2013.01); *H04H 60/04* (2013.01); *H04S 1/002* (2013.01); *H04R 2420/01* (2013.01); *H04S 7/307* (2013.01)

(58) Field of Classification Search

None

See application file for complete search history.

(56) References Cited

U.S. PATENT DOCUMENTS

| | | | | |
|---|---|---|---|---|
| 5,749,073 | A | 5/1998 | Slaney | |
| 5,793,376 | A * | 8/1998 | Tanaka et al. | 345/582 |
| 6,356,255 | B1 | 3/2002 | Weil et al. | |
| 7,181,021 | B2 * | 2/2007 | Raptopoulos et al. | 381/71.14 |
| 7,491,878 | B2 * | 2/2009 | Orr | 84/609 |
| 7,640,069 | B1 * | 12/2009 | Johnston | 700/94 |
| 7,680,288 | B2 * | 3/2010 | Melchior et al. | 381/119 |
| 8,037,413 | B2 * | 10/2011 | Johnston | 715/716 |
| 8,124,864 | B2 * | 2/2012 | Sato et al. | 84/625 |
| 8,129,606 | B2 * | 3/2012 | Sato et al. | 84/625 |
| 8,205,148 | B1 * | 6/2012 | Sharpe et al. | 715/203 |
| 8,229,754 | B1 * | 7/2012 | Ramirez et al. | 704/278 |
| 8,352,053 | B2 * | 1/2013 | Terada | 700/94 |
| 8,428,758 | B2 * | 4/2013 | Naik et al. | 700/94 |

(Continued)

FOREIGN PATENT DOCUMENTS

| | | | | |
|---|---|---|---|---|
| WO | WO 2009032795 A1 * | 3/2009 | ..... | G11B 27/038 |
| WO | WO2010075634 | 7/2010 | | |

OTHER PUBLICATIONS

Adobe, "Adobe Audition 3.0 User Guide". 2007. pp. 1-289. http://help.adobe.com/archive/en_US/audition/3/audition_3_help.pdf.*

(Continued)

*Primary Examiner* — Curtis Kuntz
*Assistant Examiner* — Qin Zhu
(74) *Attorney, Agent, or Firm* — Cantor Colburn LLP

(57) ABSTRACT

A method for creating a multi-dimensional audio map is provided. The method includes assigning a first audio attribute to a multi-dimensional space comprising at least three dimensions. The method also includes creating, by a computer processor responsive to user input, a first audio attribute layer within the multi-dimensional space, including a first dimension representing an audio attribute value of the first audio attribute for a location defined by at least two other dimensions. A method for generating a mixed output using the multi-dimensional audio map is also provided.

7 Claims, 8 Drawing Sheets

(56) References Cited

U.S. PATENT DOCUMENTS

| | | | | |
|---|---|---|---|---|
| 8,751,022 | B2 * | 6/2014 | Eppolito | 700/94 |
| 2002/0141597 | A1 * | 10/2002 | Wilcock | 381/61 |
| 2003/0095668 | A1 * | 5/2003 | Wilcock et al. | 381/56 |
| 2003/0095669 | A1 * | 5/2003 | Belrose et al. | 381/56 |
| 2004/0039463 | A1 * | 2/2004 | Sucher et al. | 700/94 |
| 2004/0069123 | A1 * | 4/2004 | Becker et al. | 84/612 |
| 2004/0176908 | A1 | 9/2004 | Senda et al. | |
| 2005/0091065 | A1 * | 4/2005 | Fay et al. | 704/278 |
| 2006/0045292 | A1 * | 3/2006 | Ando | 381/119 |
| 2007/0185909 | A1 * | 8/2007 | Klein et al. | 707/104.1 |
| 2009/0070674 | A1 * | 3/2009 | Johnston | 715/716 |
| 2009/0164905 | A1 * | 6/2009 | Ko | 715/727 |
| 2009/0310800 | A1 * | 12/2009 | Takemura et al. | 381/119 |
| 2011/0132178 | A1 * | 6/2011 | Sato et al. | 84/622 |
| 2011/0191674 | A1 * | 8/2011 | Rawley et al. | 715/702 |
| 2012/0046954 | A1 * | 2/2012 | Lindahl et al. | 704/500 |
| 2012/0053710 | A1 * | 3/2012 | Lindahl et al. | 700/94 |
| 2012/0170757 | A1 * | 7/2012 | Kraemer et al. | 381/17 |
| 2012/0275626 | A1 * | 11/2012 | Miura | 381/119 |
| 2013/0025437 | A1 * | 1/2013 | Serletic et al. | 84/634 |
| 2013/0178964 | A1 * | 7/2013 | Bergmann | 700/94 |
| 2014/0119581 | A1 * | 5/2014 | Tsingos et al. | 381/300 |
| 2014/0140536 | A1 * | 5/2014 | Serletic et al. | 381/98 |

OTHER PUBLICATIONS

Adobe Audition / Clip volume matching, fading, and mixing, [online—retrieved from the Internet on May 30, 2012] http://help.adobe.com/en_US/audition/cs/using/WS1321CAC4-3974-4e2a-AC94-F929A5C256A3.
html#WS58a04a822e3e5010548241038980c2c5-7e8f, 3 pages.

Artificial Terrain Tools & Software Packages, http://vterrain.org/Packages/Artificial/, May 17, 2012, 6 pages.

McGee, R.; "Auditory Displays and Sonification: Introduction and Overview"; University of California, Santa Barbara; Mat200C; Spring 2009, 10 pages.

Sloan, et al., Color Map Techniques; http://www.ip.com/pubview/IPCOM000128621D; Dec. 31, 1978, 16 pages.

Logic Help View Topic—Crossfades on multiple tracks [SOLVED], http://logicprohelp.com/forum/viewtopic.php? p=168648 &sid=b5a804bf5b214a2e3eaca52d, May 17, 2012, 2 pages.

Pickover, et al.; Pattern Analysis for Musical Melodies; http://www.ip.com/pubview/IPCOM000040606D; Dec. 1, 1987, 3 pages.

Soundtrack Pro 3 User Manual: Creating Fades and Crossfaes in the Timeline, http://documentation.apple.com/en/soundtrackpro/usermanual/index.html, May 17, 2012, 7 pages.

* cited by examiner

MULTI-DIMENSIONAL AUDIO TRANSFORMATIONS AND CROSSFADING

CROSS REFERENCE TO RELATED APPLICATIONS

This is a continuation application that claims the benefit of U.S. patent application Ser. No. 13/479,900 filed May 24, 2012, the contents of which are incorporated by reference herein in their entirety.

BACKGROUND

The present invention relates to audio signal processing and, more specifically, to multi-dimensional audio transformations and crossfading.

A fader gradually increases or decreases volume level of an audio signal. A disc jockey (DJ) mixer typically includes a crossfader that essentially functions as two faders connected side-by-side, but in opposite directions. The crossfader is limited however, in that it only permits a linear transition from song A to song B. The process begins with lowering the volume level of song A, while simultaneously raising the volume level of song B. The user of the DJ mixer determines how much overlap there is in these two volume altering operations, which can range from a large overlap to essentially no overlap at all.

SUMMARY

According to one embodiment of the present invention, a method for creating a multi-dimensional audio map is provided. The method includes assigning a first audio attribute to a multi-dimensional space including at least three dimensions. The method also includes creating, by a computer processor responsive to user input, a first audio attribute layer within the multi-dimensional space, including a first dimension representing an audio attribute value of the first audio attribute for a location defined by at least two other dimensions.

According to another embodiment of the present invention, a method for generating a mixed output using a multi-dimensional audio map is provided. The method includes reading a first audio file by a computer processor. The method also includes accessing a multi-dimensional audio map by the computer processor. The multi-dimensional audio map includes a plurality of audio attribute layers. Each of the audio attribute layers includes a first dimension representing an audio attribute value for a location defined by at least two other dimensions within a multi-dimensional space. The method further includes determining a path to transition between two points in the multi-dimensional audio map. The method also includes transitioning between the two points in the multi-dimensional audio map by selecting corresponding values from each of the plurality of audio attribute layers between the two points. The method additionally includes generating a mixed output by the computer processor applying the corresponding values from each of the plurality of audio attribute layers between the two points to a portion of the first audio file.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
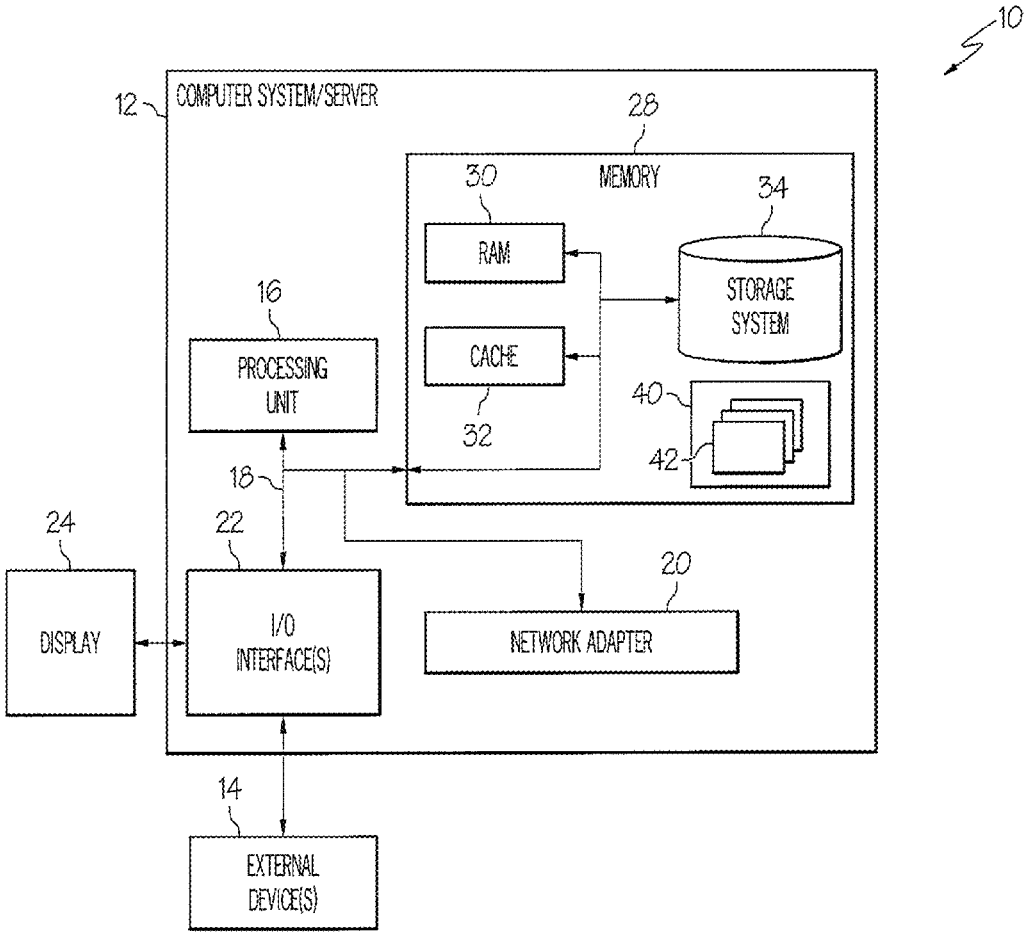
FIG. 1 depicts a cloud computing node according to an embodiment of the present invention.

Exemplary embodiments relate to multi-dimensional audio transformations and crossfading. In an exemplary embodiment, an audio authoring tool enables creation of multi-dimensional audio maps. Each multi-dimensional audio map may be a stack of three-dimensional audio attribute layers, where each three-dimensional audio attribute layer represents an audio attribute to modify in one or more audio compositions. Example audio attributes include: volume, bass, treble, tone parameters, tempo, reverb, and the like. Additionally, audio attributes can be isolated on a per instrument basis, a per vocal-source basis, and a per channel basis. A multi-dimensional crossfader can be used to permit a non-linear transition between two or more audio compositions using a multi-dimensional audio map. Multi-dimensional crossfading creates a composite sound as each of the attributes are evaluated and mixed according to the multi-dimensional audio map. The audio authoring tool and multi-dimensional crossfader can be provided through any number of computing environments and services. The multi-dimensional audio map can be depicted visually as a contour map (also referred to as an audio contour map), but it need not be depicted visually. Rather, a multi-dimensional audio map is any stack of audio attribute layers whether defined as tables, equations, or other data structures, and may be stored and accessed in a raw format without a visual representation.

It is understood in advance that although this disclosure includes a detailed description on cloud computing, implementation of the teachings recited herein are not limited to a cloud computing environment. Rather, embodiments are capable of being implemented in conjunction with any other type of computing environment now known or later developed (e.g., any client-server model).

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as Follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as Follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as Follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via I/O interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
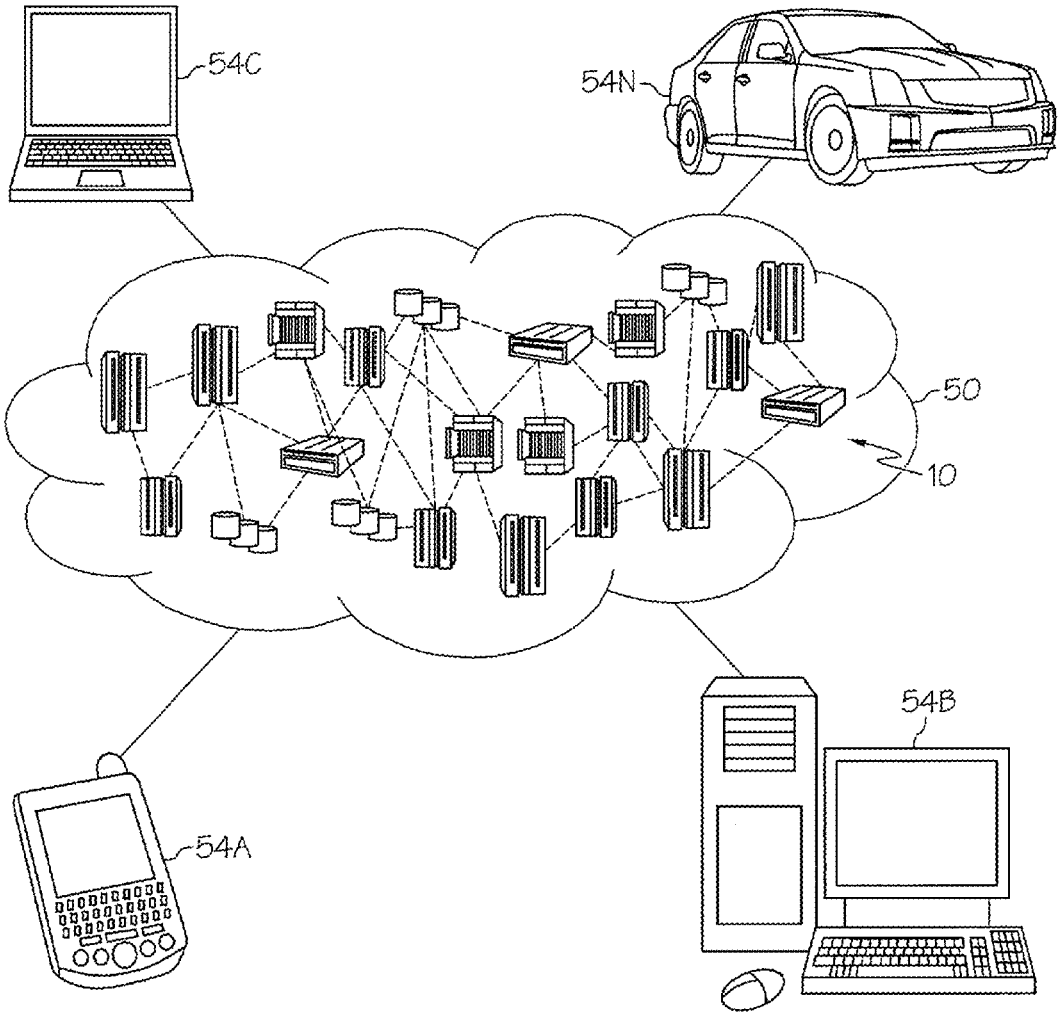
FIG. 2 depicts a cloud computing environment according to an embodiment of the present invention.

Referring now to FIG. 2, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
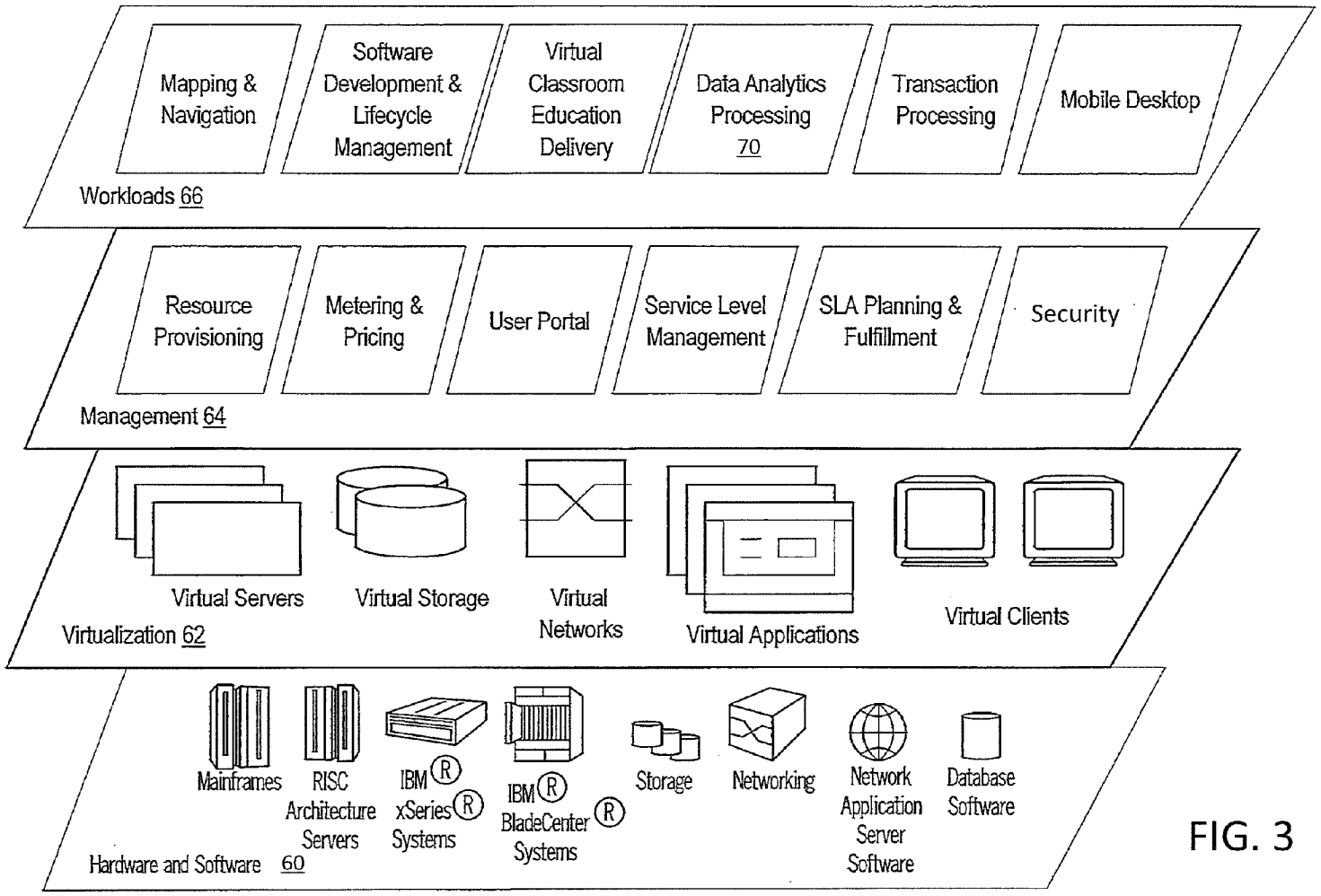
FIG. 3 depicts abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Hardware and software layer 60 includes hardware and software components. Examples of hardware components include mainframes, in one example IBM® zSeries® systems; RISC (Reduced Instruction Set Computer) architecture based servers, in one example IBM pSeries® systems; IBM xSeries® systems; IBM BladeCenter® systems; storage devices; networks and networking components. Examples of software components include network application server software, in one example IBM WebSphere® application server software; and database software, in one example IBM DB2® database software. (IBM, zSeries, pSeries, xSeries, BladeCenter, WebSphere, and DB2 are trademarks of International Business Machines Corporation registered in many jurisdictions worldwide)

Virtualization layer 62 provides an abstraction layer from which the following examples of virtual entities may be provided: virtual servers; virtual storage; virtual networks, including virtual private networks; virtual applications and operating systems; and virtual clients.

In one embodiment, one or both of the hardware and software layer 60 and the virtualization layer 62 may include edge components, such as a web server front end and multi-dimensional audio map cache, as well as a multi-dimensional audio map library store, e.g., in a high-performance RAID storage area network (SAN).

In one example, management layer 64 may provide the functions described below. Resource provisioning provides dynamic procurement of computing resources and other resources that are utilized to perform tasks within the cloud computing environment. Metering and Pricing provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal provides access to the cloud computing environment for consumers and system administrators. Service level management provides cloud computing resource allocation and management such that required service levels are met. Service Level Agreement (SLA) planning and fulfillment provide pre-arrangement for, and procurement of, cloud computing resources for which a future requirement is anticipated in accordance with an SLA.

Workloads layer 66 provides examples of functionality for which the cloud computing environment may be utilized. Examples of workloads and functions which may be provided from this layer include: mapping and navigation; software development and lifecycle management; virtual classroom education delivery; data analytics processing 70; transaction processing; and a mobile desktop for mobile devices (e.g., 54A, 54C, and 54N, as well as mobile nodes 10 in cloud computing environment 50) accessing the cloud computing services. In one exemplary embodiment, data analytics processing 70 in the workloads layer 66 implements the exemplary processes described herein; however, it will be understood that the exemplary processes may be implemented in any layer.

The data analytics processing 70 includes one or more algorithms to implement embodiments described herein to provide multi-dimensional audio map creation and multi-dimensional crossfader services. In an embodiment, the data analytics processing 70 is coupled to and/or resides in the memory 28 shown in FIG. 1. In addition, embodiments of the data analytics processing 70 include one or more program modules 42 of the program/utility 40 shown in FIG. 1. In a further embodiment, the data analytics processing 70 is executed on hardware located in the hardware and software layer 60.

The exemplary multi-dimensional audio map creation and multi-dimensional crossfader services provide the ability create multi-dimensional audio maps having multiple attribute layers and generate a cross mixed output using multi-dimensional crossfading.

Figure 4:
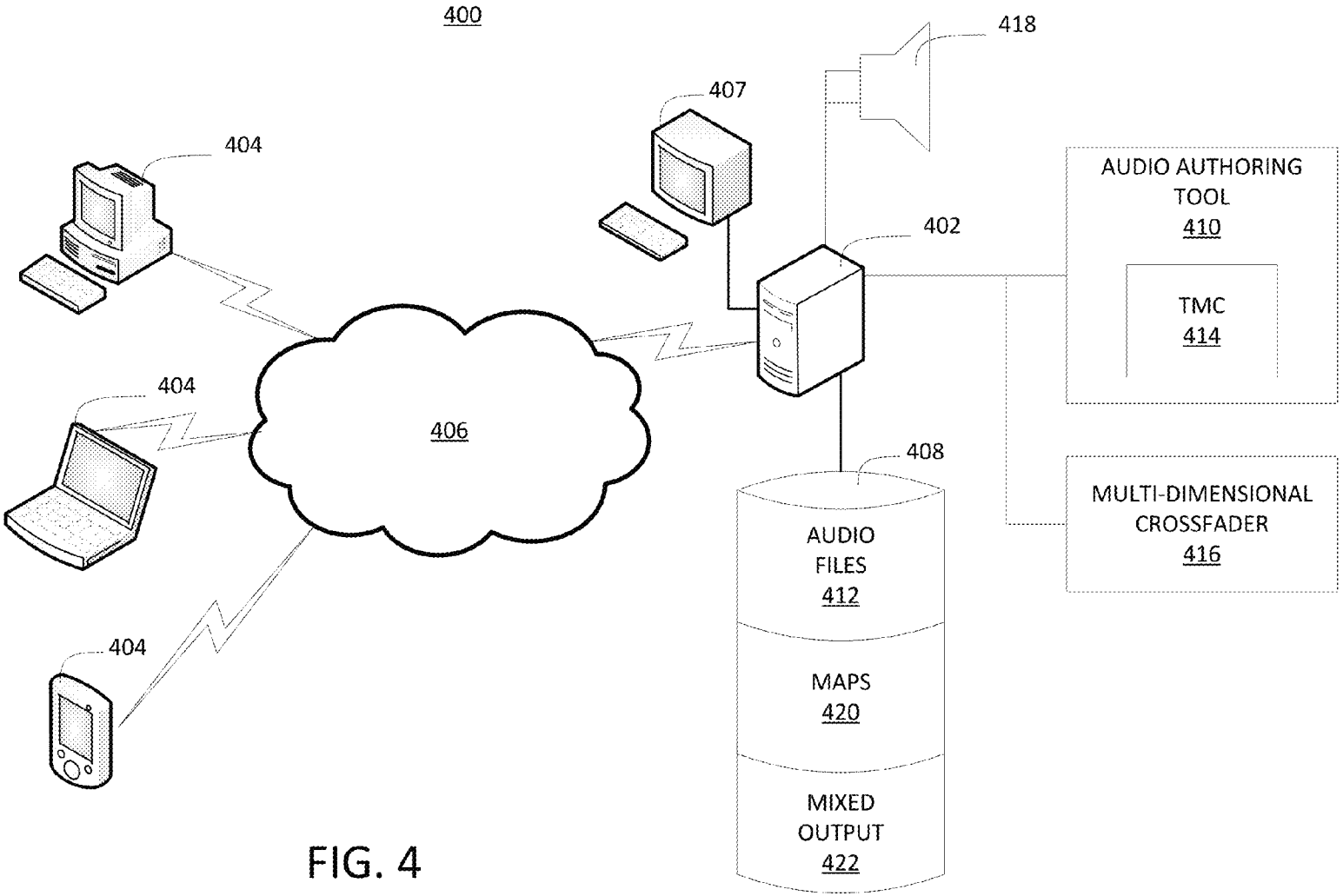
FIG. 4 depicts a block diagram of a system upon which multi-dimensional crossfading may be implemented according to an embodiment of the present invention.

Turning now to FIG. 4, an example of a system 400 upon which multi-dimensional audio map creation and multi-dimensional crossfading may be implemented will now be described in greater detail. The system 400 may form a portion of the cloud computing environment 50 of FIG. 2. The system 400 of FIG. 4 includes an audio processing system 402 in communication with user systems 404 over a network 406. In exemplary embodiments, the audio processing system 402 is a high-speed processing device (e.g., a mainframe computer, a desktop computer, a laptop computer, a handheld device, an embedded computing device, or the like) including at least one processing circuit (e.g., a computer processor/CPU) capable of reading and executing instructions, and handling interactions with various components of the system 400.

In exemplary embodiments, the user systems 404 comprise desktop, laptop, general-purpose computer devices, mobile computing devices, and/or networked devices with processing circuits and I/O interfaces, such as a keyboard, a display device and audio output. The audio processing system 402 and user systems 404 can include various computer hardware and software technology known in the art, such as one or more processing units or circuits, volatile and non-volatile memory including removable media, power supplies, network interfaces, support circuitry, operating systems, and the like. The audio processing system 402 may also include one or more user interfaces 407 with user accessible I/O devices, such as a keyboard, mouse, and display. Other examples of I/O devices that are configured to provide input to system 400 include various indicators and areas, such as a stylus, motion sensors, switches, knobs, buttons, dials, trackpads, touchscreens, and the like. The one or more user interfaces 407 enable one or more local users to access the audio processing system 402 without communicating over the network 406. For example, the network 406 and user systems 404 can be omitted, where user interaction is performed through the one or more user interfaces 407 and the audio processing system 402 is implemented as a stand-alone configuration.

The network 406 may be any type of communications network known in the art. The network 406 may be a cloud computing network (e.g., cloud computing environment 50 of FIG. 2) that offers virtual computing services to end users. Alternatively, the network 406 may be an intranet, extranet, or an internetwork, such as the Internet, or a combination thereof. The network 406 can include wireless, wired, and/or fiber optic links. Additional computer systems (not depicted) may also access the audio processing system 402 via the network 406 or other networks.

The system 400 also includes a data storage system 408. The data storage system 408 refers to any type of computer readable storage media and may comprise one or more secondary storage elements, e.g., hard disk drive (HDD), solid-state memory, tape, or a storage subsystem that is internal or external to the audio processing system 402. Types of data that may be stored in the data storage system 408 include, for example, various files and databases. It will be understood that the data storage system 408 shown in FIG. 4 is provided for purposes of simplification and ease of explanation and is not to be construed as limiting in scope. To the contrary, there may be multiple data storage systems 408 utilized by the audio processing system 402, which can be distributed in various locations of the system 400.

The audio processing system 402 may execute an audio authoring tool 410 and a multi-dimensional crossfader 416. In the example of FIG. 4, the audio authoring tool 410 includes a terrain map control 414. The audio authoring tool 410 can include the multi-dimensional crossfader 416 or the audio authoring tool 410 and multi-dimensional crossfader 416 can be separate applications. The audio authoring tool 410 and multi-dimensional crossfader 416 may be workloads of the data analytics processing 70 described above in FIG. 3. The audio processing system 402 is communicatively coupled to the data storage system 408 that stores files and/or databases accessible by the audio authoring tool 410, terrain map control 414, and multi-dimensional crossfader 416. For example, the data storage system 408 can store audio files 412, multi-dimensional audio maps 420, and mixed output 422. Alternatively, the mixed output 422 can be output as audio through one or more speakers 418 without storage to the data storage system 408 or sent over network 406 to one or more user systems 404.

Figure 5:
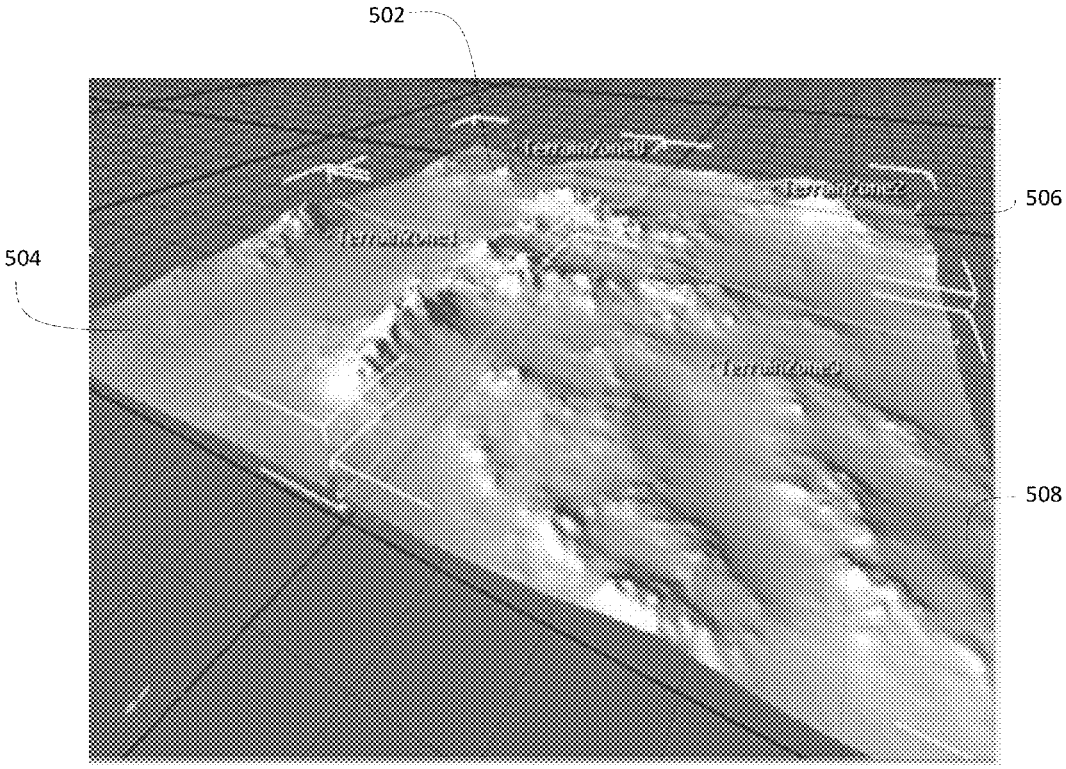
FIG. 5 depicts an example visualization of an attribute layer of a multi-dimensional audio map according to an embodiment of the present invention.

In exemplary embodiments, a user creates and/or edits multi-dimensional audio maps 420 using audio authoring tool 410. Each of the multi-dimensional audio maps 420 can include one or more audio attribute layers. Each of the audio attribute layers may be managed as an audio contour map, where various attribute values are distributed to form an attribute terrain. The audio authoring tool 410 includes visual terrain construction functions to form and modify the attribute terrain as an audio contour map for each audio attribute layer. FIG. 5 depicts an example visualization of an audio attribute layer 500 of one of the multi-dimensional audio maps 420. Using the terrain map control 414 of FIG. 4, a user can navigate and modify the audio attribute layer 500. In the example of FIG. 5, a user may partition the audio attribute layer 500 into multiple terrain zones 502, 504, 506, and 508. Partitioning the audio attribute layer 500 may be useful to identify particular terrain regions that the user deems more appropriate to accomplish desired effects. For example, when applied to music files, certain terrain zones may be more appropriate to particular music genres. Although depicted visually, each audio attribute layers need not be displayed. Each audio attribute layer may simply be a two-dimensional table, where the audio attribute value at each table cell location represents a third dimension. Additionally, rather than a table, each audio attribute layer can be defined by a series of equations that can be mapped to a grid.

The terrain map control 414 of FIG. 4 can also be used to combine multiple audio attribute layers to form one of the multi-dimensional audio maps 420. In the example depicted in FIG. 6, audio attribute layers 602, 604, and 606 are stacked to form a multi-dimensional audio map 600. Each of the audio attribute layers 602, 604, 606 represents a different audio attribute, such as volume, balance, reverb, tempo, instrument profile (i.e., strings vs. brass), and other attributes. Each of the audio attribute layers 602, 604, and 606 may be normalized according to user designated coordinates in a Euclidean plane. Therefore, locations in one or more of the audio attribute layers 602, 604, and 606 can be non-linearly distributed with respect to time. As a further example, audio attribute values forming each of the audio attribute layers 602, 604, and 606 may be organized in a multi-dimensional table, which need not have a direct correlation to time. When the audio attribute layers 602, 604, and 606 are overlaid, a corresponding value is selected from each of the audio attribute layers 602, 604, and 606 and applied to one or more audio files 412 by the multi-dimensional crossfader 416 of FIG. 4 to produce mixed output 422. The terrain map control 414 of FIG. 4 allows a user to create one or more paths through the multi-dimensional audio map 600. A rate of movement across a path of the multi-dimensional audio map 600 can change a rate of transition in the mixed output 422. The multi-dimensional crossfader 416 may also combine output generated from multiple paths and involve multiple multi-dimensional audio maps 420 and multiple audio files 422 to generate the mixed output 422.

The terrain map control 414 of FIG. 4 may be presented to a user as a two-dimensional widget. As the user moves a cursor around on the terrain map control 414 in the two-dimensional plane, the value of the third axis for each audio attribute layer can be applied to a selected audio file by the multi-dimensional crossfader 416 of FIG. 4. Two or more audio files can also be mapped to locations in the two-dimensional space, such that moving between and around one audio file and another causes a seamless transition from one audio file any number of other audio files according to the multi-dimensional audio map 600. As such, non-linear, multi-attribute, multi-song transitions can be performed.

The terrain map control 414 supports manual control, and automatic trajectory control. Manual control of the terrain map control 414 allows the user to drag a cursor around on the terrain map control 414 in any speed or direction. As the cursor is moved, audio attributes of the mixed output 422 are altered as disclosed above. In order to apply a variety of audio attributes to an audio file using the multi-dimensional audio map 600, the multi-dimensional crossfader 416 may decompose the audio files 412 according to attribute types stored in the multi-dimensional audio map 600, such that each of the audio attribute layers 602, 604, and 606 acts on corresponding attributes of the audio files 412 to produce the mixed output 422.

Automatic trajectory control allows the user to aim the cursor from the current position to a new position on the terrain map control 414. The user can perform this function by double clicking the cursor, then dragging the cursor to the new final location, and double clicking at the final location. The user may draw a straight line or an arbitrary path to the final position. The next time the user clicks on the cursor, it begins moving automatically toward the final position along the path as drawn by the user. The speed of movement can be determined by configurable user preferences, and the length of the user drawn path. As the cursor moves toward the final position, the audio attributes mapped by each audio attribute layer in the terrain map control 414 are evaluated, and the mixed output 422 is altered.

The multi-dimensional crossfader 416 of FIG. 4 can receive input from an indicator, such as a stylus, a detected gesture, a switch, a sliding nub, or a mouse pointer, for denoting a coordinate in at least two dimensions. Another input can be received from an area, such as a trackpad, a touchscreen, or a software widget, for sensing the coordinate. The indicator and the area may be included in the user accessible I/O devices as previously described. The multi-dimensional crossfader 416 looks up one or more audio attributes associated with the sensed coordinate from the multi-dimensional audio maps 420 to generate the mixed output 422.

As a further example, a user can invoke the audio authoring tool 410 and read the audio files 412, referred to as song A and song B in this example. To determine a mix for transitioning from song A to song B, the audio authoring tool 410 can analyze the end of song A and beginning of song B over a selected time period. From this analysis, it may be determined that song A is 110 beats per minute and song B is 80 beats per minute. An existing multi-dimensional audio map can be accessed or a new multi-dimensional audio map can be created in the multi-dimensional audio maps 420 by the terrain map control 414 that includes audio attribute layers for tempo and volume. A path through the associated multi-dimensional audio map is created that includes a change from 110 beats per minute to 80 beats per minute in a tempo audio attribute layer while the volume is initially reduced and then restored in a volume audio attribute layer. The multi-dimensional crossfader 416 analyzes the pitch of last note of song A and adjusts frequency according to the path defined through the associated multi-dimensional audio map. The resulting transition between songs A and B includes both a change in tempo from one speed to another at the same time the volume is changing in the mixed output 422.

Figure 6:
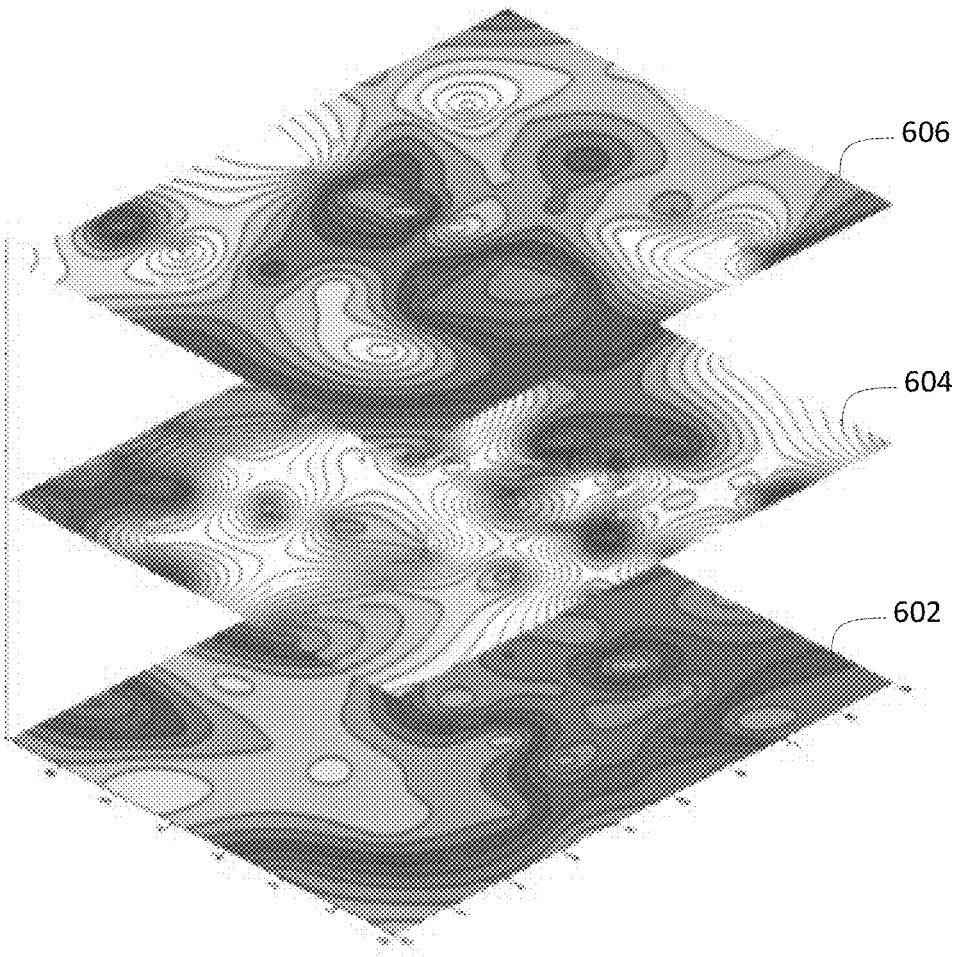
FIG. 6 depicts an example visualization of a stack of audio attribute layers of a multi-dimensional audio map according to an embodiment of the present invention.
Figure 7:
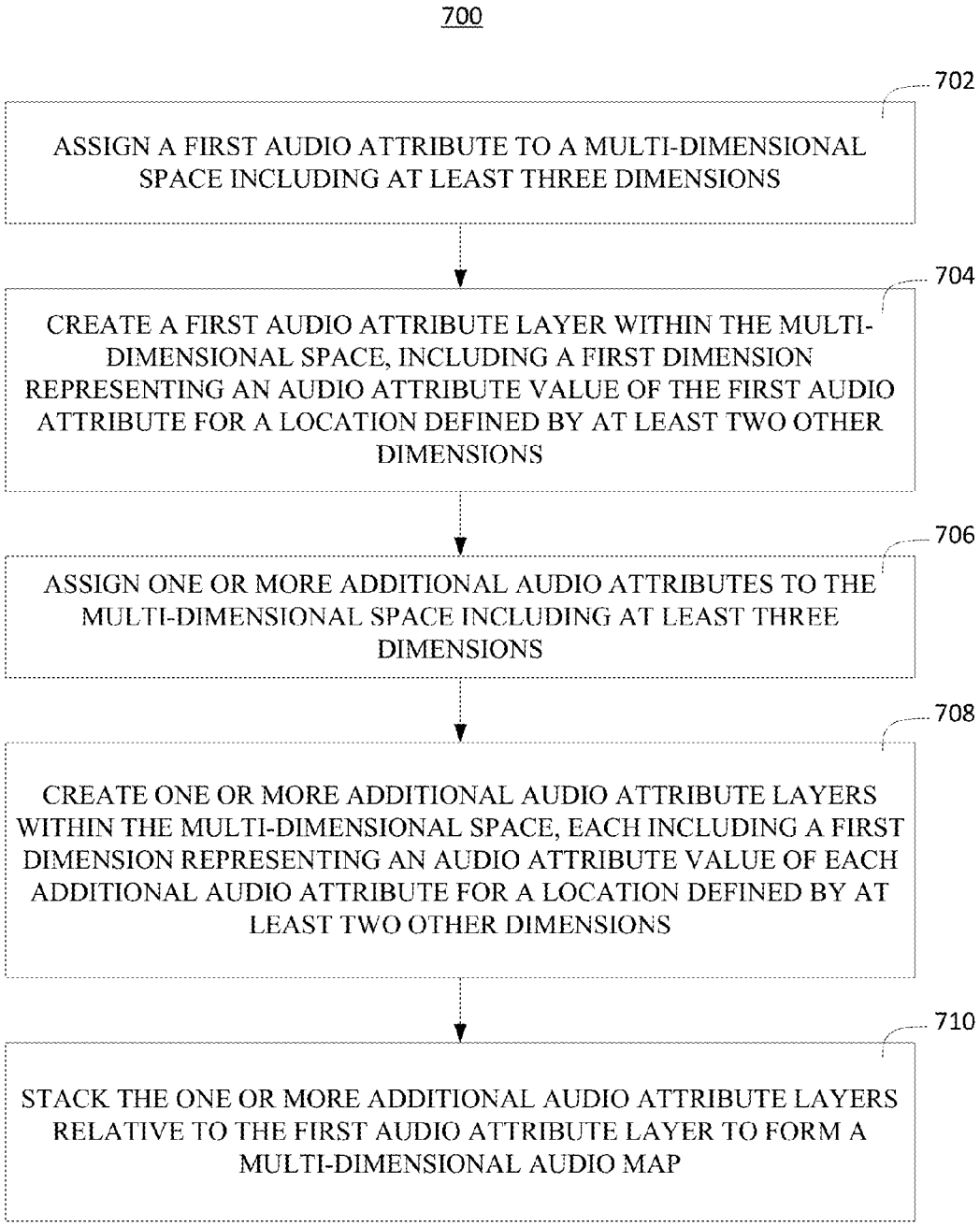
FIG. 7 depicts a flow diagram of a process for constructing a multi-dimensional audio map according to an embodiment of the present invention.

Turning now to FIG. 7, a process 700 for constructing a multi-dimensional audio map will now be described in an exemplary embodiment. The process 700 is described in reference to FIGS. 4-6 and can be implemented by the audio authoring tool 410 in conjunction with the terrain map control 414 of FIG. 4.

At block 702, a first audio attribute is assigned to a multi-dimensional space including at least three dimensions. At block 704, a first audio attribute layer is created within the multi-dimensional space. The first audio attribute layer includes a first dimension representing an audio attribute value of the first audio attribute for a location defined by at least two other dimensions. The at least two other dimensions can be rows and columns, such that at least two rows and at least two columns define X-Y coordinates of each audio attribute layer and the audio attribute values provide Z-coordinates. An example of an audio attribute layer created as an audio contour map is depicted as audio attribute layer 500 of FIG. 5. While depicted as an audio contour map, each audio attribute layer need not be visually displayed as an audio contour map. Rather, the first audio attribute layer may be an aggregation of data points that can be mapped to a grid in a multi-dimensional space. Alternatively, the first audio attribute layer may be defined by a series of equations that define audio attribute values mapped relative to at least two other dimensions within a multi-dimensional space.

At block 706, one or more additional audio attributes are assigned to the multi-dimensional space including at least three dimensions. At block 708, one or more additional audio attribute layers are created within the multi-dimensional space. Each of the one or more additional audio attribute layers includes a first dimension representing an audio attribute value of each additional audio attribute for a location defined by at least two other dimensions. At block 710, the one or more additional audio attribute layers are stacked relative to the first audio attribute layer to form a multi-dimensional audio map. As depicted in FIG. 6, the multi-dimensional audio map 600 includes stacked audio attribute layers 602, 604, and 606, where audio attribute layer 602 may be a first audio attribute layer created as an audio contour map and audio attribute layers 604 and 606 are additional audio attribute layers created as audio contour maps. The multi-dimensional audio map created by process 700 can be stored as one of the multi-dimensional audio maps 420.

Figure 8:
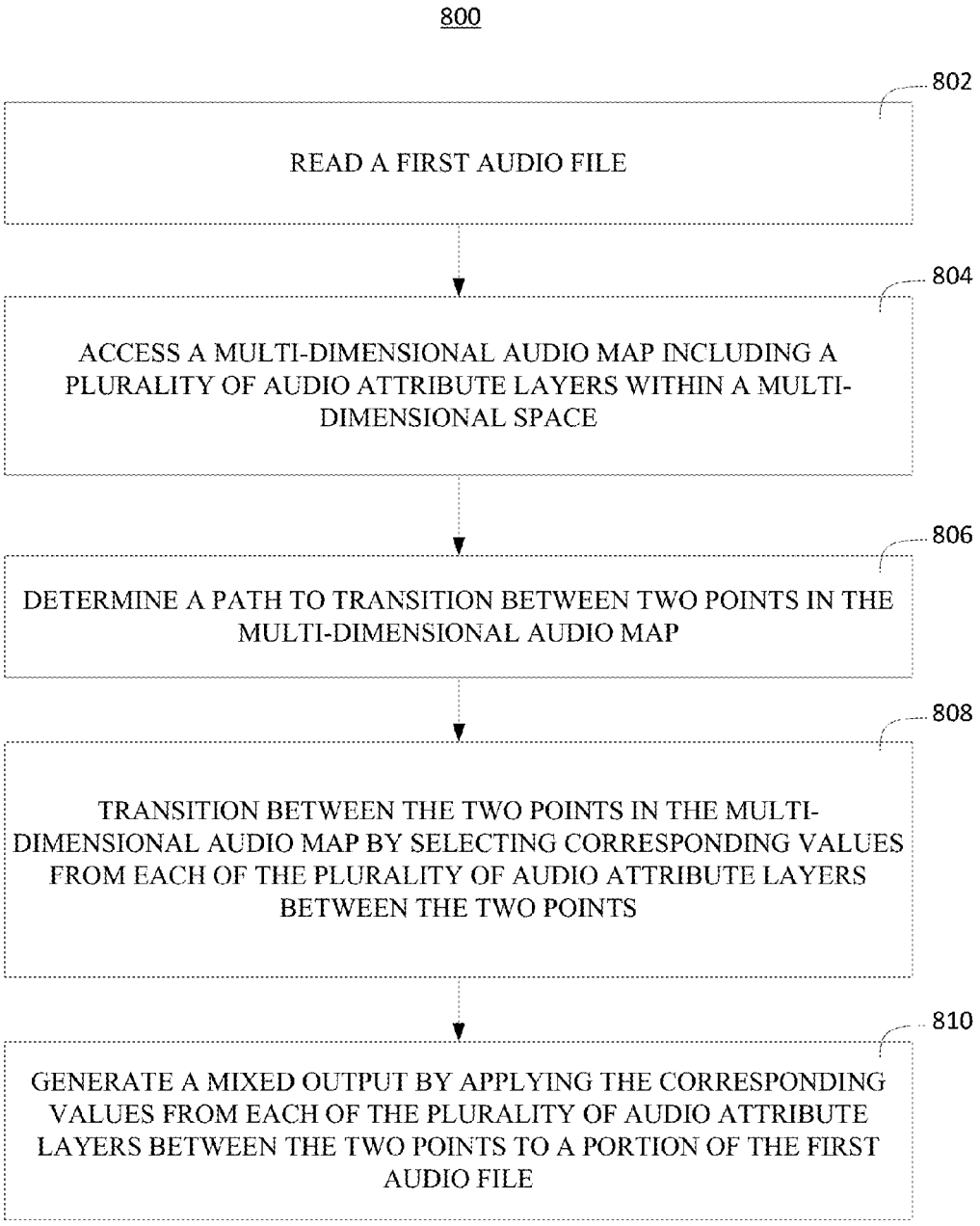
FIG. 8 flow diagram of a process for crossfading using a multi-dimensional audio map according to an embodiment of the present invention.

Turning now to FIG. 8, a process 800 for crossfading using a multi-dimensional audio map will now be described in an exemplary embodiment. The process 800 is described in reference to FIGS. 4-6 and can be implemented by the multi-dimensional crossfader 416 of FIG. 4.

At block 802, a first audio file is read. The first audio file can be one of the audio files 412. At block 804, a multi-dimensional audio map is accessed. The multi-dimensional audio map can be one of the multi-dimensional audio maps 420, an example of which is visually depicted as multi-dimensional audio map 600. The multi-dimensional audio map includes a plurality of audio attribute layers, such as audio attribute layers 602, 604, and 606 of multi-dimensional audio map 600. Each of the audio attribute layers may include an audio contour map within a multi-dimensional space. While depicted as an audio contour map, each audio attribute layer need not be visually displayed as an audio contour map. Rather, each audio attribute layer may be an aggregation of data points that can be mapped to a grid in a multi-dimensional space. Alternatively, audio attribute layers may be defined by a series of equations that define audio attribute values mapped relative to at least two other dimensions within a multi-dimensional space.

At block 806, a path to transition between two points in the multi-dimensional audio map is determined. User input can be received from an indicator to denote a pair of coordinates in at least two dimensions for the two points, and from an area to sense the coordinates. The indicator and area can be I/O devices of user systems 404 or user interfaces 407. The multi-dimensional crossfader 416 can look up one or more audio attributes associated with each of the sensed coordinates from the multi-dimensional audio map and for locations in between.

At block 808, a transition between the two points in the multi-dimensional audio map is performed by selecting corresponding values from each of the plurality of audio attribute layers between the two points. At block 810, mixed output 422 is generated by applying the corresponding values from each of the plurality of audio attribute layers between the two points to a portion of the first audio file. A transition speed between the two points controls a rate of adjustment of the mixed output 422, and the mixed output 422 can be adjusted between the two points according to user configurable preferences. The mixed output 422 may be written to data storage system 408, sent to one or more of the user systems 404 or user interfaces 407, and/or output as audio through one or more speakers 418.

The multi-dimensional cross fader 416 may also read a second audio file from the audio files 412 and generate the mixed output 422 by applying the corresponding values from each of the plurality of audio attribute layers between the two points to a portion of the second audio file. The portions of the first and second audio files used to generate the mixed output 422 may be an end portion, e.g., last 5 seconds, of the first audio file and a beginning portion, e.g., first 5 seconds, of the second audio file. The multi-dimensional cross fader 416 can determine a first plurality of audio attributes of the first audio file corresponding to the plurality of audio attribute layers in the multi-dimensional audio map, and further determine a second plurality of audio attributes of the second audio file corresponding to the plurality of audio attribute layers in the multi-dimensional audio map. The multi-dimensional cross fader 416 may apply audio attribute values from each the plurality of audio attribute layers to corresponding audio attributes in the first plurality of audio attributes and in the second plurality of audio attributes to generate the mixed output 422.

Technical effects include creation of multi-dimensional audio maps and generation of mixed audio output by applying one or more of the multi-dimensional audio maps to one or more audio files. For visualization and transition design, audio attribute layers in a multi-dimensional audio map can be depicted and managed as audio contour maps.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed:

1. A method of creating multi-dimensional audio maps for a multi-dimensional crossfader using an audio authoring tool, comprising:

assigning a first audio attribute to a multi-dimensional space comprising at least three dimensions;

creating, by the audio authoring tool executing on a computer processor responsive to user input, a first audio attribute layer within the multi-dimensional space, including a first dimension representing an audio attribute value of the first audio attribute for a location defined by at least two other dimensions;

assigning one or more additional audio attributes to the multi-dimensional space comprising at least three dimensions;

creating, by the audio authoring tool executing on the computer processor responsive to user input, one or more additional audio attribute layers within the multi-dimensional space, each of the one or more additional audio attribute layers including a first dimension representing an audio attribute value of each additional audio attribute for a location defined by at least two other dimensions;

stacking the one or more additional audio attribute layers relative to the first audio attribute layer to form a multi-dimensional audio map that overlays the one or more additional audio attribute layers upon the first audio attribute layer as separate planes normalized according to coordinates in a Euclidean plane, wherein one of the audio attribute layers comprises a tempo audio attribute layer and another of the audio attribute layers comprises a volume audio attribute layer, and each of the first audio attribute layer and the one or more additional audio attribute layers is uncorrelated with respect to time; and storing the multi-dimensional audio map in non-transitory computer readable memory for the multi-dimensional crossfader.

2. A method for crossfading by a multi-dimensional crossfader to generate mixed audio output, comprising:

reading a first audio file by the multi-dimensional crossfader executing on a computer processor;

reading a second audio file by the multi-dimensional crossfader executing on the computer processor;

accessing a multi-dimensional audio map by the multi-dimensional crossfader executing on the computer processor, the multi-dimensional audio map comprising a plurality of audio attribute layers that are overlaid upon each other as separate planes normalized according to coordinates in a Euclidean plane, each of the audio attribute layers is uncorrelated with respect to time and comprises a first dimension representing an audio attribute value for a location defined by at least two other dimensions within a multi-dimensional space, wherein one of the audio attribute layers comprises a tempo audio attribute layer and another of the audio attribute layers comprises a volume audio attribute layer;

analyzing an ending portion of the first audio file to identify a first tempo;

analyzing a beginning portion of the second audio file to identify a second tempo;

determining a path to transition between two points comprising a first point and a second point in the multi-dimensional audio map, wherein the first point aligns with the first tempo in the tempo audio attribute layer and has an associated first volume in the volume audio attribute layer, and the second point aligns with the second tempo in the tempo audio attribute layer and has an associated second volume in the volume audio attribute layer;

transitioning between the two points in the multi-dimensional audio map by selecting corresponding values from each of the plurality of audio attribute layers between the two points; and generating a mixed output by the multi-dimensional crossfader executing on the computer processor applying the corresponding values from each of the plurality of audio attribute layers between the two points to the ending portion of the first audio file with respect to time and to the beginning portion of the second audio file with respect to time, the mixed output comprising both a change in tempo and volume between the ending portion of the first audio file and the beginning portion of the second audio file.

3. The method of claim 2, further comprising:

determining a first plurality of audio attributes of the first audio file corresponding to the plurality of audio attribute layers in the multi-dimensional audio map;

determining a second plurality of audio attributes of the second audio file corresponding to the plurality of audio attribute layers in the multi-dimensional audio map; and applying audio attribute values from each the plurality of audio attribute layers to corresponding audio attributes in the first plurality of audio attributes and in the second plurality of audio attributes to generate the mixed output.

4. The method of claim 2, wherein a plurality of locations in one or more of the audio attribute layers are non-linearly distributed with respect to time.

5. The method of claim 2, wherein a transition speed between the two points controls a rate of adjustment of the mixed output.

6. The method of claim 2, wherein the mixed output is adjusted between the two points according to user configurable preferences.

7. The method of claim 2, further comprising:

analyzing a last note pitch of the first audio file to determine a frequency; and adjusting the frequency in the mixed output according to the path to transition between the first audio file and the second audio file while the volume is initially reduced and then restored.

* * * * *